US006675791B1

(12) United States Patent
Alexander et al.

(10) Patent No.: US 6,675,791 B1
(45) Date of Patent: Jan. 13, 2004

(54) PRESSURE REGULATOR FOR PNEUMATIC GUNS

(75) Inventors: Aaron K. Alexander, Indianapolis, IN (US); Larry G. Alexander, Indianapolis, IN (US)

(73) Assignee: AKALMP, Inc., Indianapolis, IN (US)

( * ) Notice: Subject to any disclaimer, the term of this patent is extended or adjusted under 35 U.S.C. 154(b) by 47 days.

(21) Appl. No.: 10/052,069

(22) Filed: Jan. 17, 2002

(51) Int. Cl.[7] ..... F41B 11/06; F41B 11/26
(52) U.S. Cl. ..... 124/71; 124/74
(58) Field of Search ..... 124/71, 74, 69, 124/70, 72, 73

(56) References Cited

U.S. PATENT DOCUMENTS

| | | | | |
|---|---|---|---|---|
| 2,304,320 A | | 12/1942 | Tratsch | |
| 2,554,116 A | | 5/1951 | Monner | |
| 2,568,432 A | | 9/1951 | Cook | |
| 2,594,240 A | | 4/1952 | Wells | |
| 2,634,717 A | | 4/1953 | Junkin | |
| 2,834,332 A | | 5/1958 | Guthrie | |
| 2,845,055 A | | 7/1958 | Collins et al. | |
| 2,845,805 A | | 8/1958 | Crewe | |
| 3,089,476 A | | 5/1963 | Wolverton | |
| 3,192,915 A | | 7/1965 | Norris et al. | |
| 3,662,729 A | | 5/1972 | Henderson | |
| 3,695,246 A | | 10/1972 | Filippi et al. | |
| 3,921,980 A | | 11/1975 | Artzer | |
| 4,094,294 A | | 6/1978 | Speer | |
| 4,215,867 A | | 8/1980 | Natwick | |
| 4,350,447 A | | 9/1982 | Landa | |
| 4,362,145 A | | 12/1982 | Stelcher | |
| 4,770,153 A | | 9/1988 | Edelman | |
| 4,819,609 A | | 4/1989 | Tippmann | |
| 4,899,717 A | | 2/1990 | Rutten et al. | |
| 4,936,282 A | | 6/1990 | Dobbins et al. | |
| 5,228,427 A | | 7/1993 | Gardner, Jr. | |
| 5,280,778 A | | 1/1994 | Kotsiopoulos | |
| 5,285,765 A | | 2/1994 | Lee | |
| 5,333,594 A | | 8/1994 | Robinson | |
| 5,373,833 A | | 12/1994 | D'Andrade | |
| 5,383,442 A | | 1/1995 | Tippmann | |
| 5,413,083 A | | 5/1995 | Jones | |
| 5,494,024 A | | 2/1996 | Scott | |
| 5,572,982 A | | 11/1996 | Williams | |
| 5,704,342 A | * | 1/1998 | Gibson et al. | 124/73 |
| 5,878,736 A | | 3/1999 | Lotuaco, III | |
| 5,881,707 A | | 3/1999 | Gardner, Jr. | |
| 5,950,611 A | * | 9/1999 | Lopez et al. | 124/72 |
| 5,954,042 A | * | 9/1999 | Harvey | 124/51.1 |
| 5,967,133 A | | 10/1999 | Gardner, Jr. | |
| 6,003,504 A | | 12/1999 | Rice et al. | |
| 6,035,843 A | | 3/2000 | Smith et al. | |
| 6,065,460 A | | 5/2000 | Lotuaco, III | |
| 6,273,080 B1 | * | 8/2001 | Sullivan, Jr. | 124/84 |
| 6,347,622 B1 | * | 2/2002 | Hsueh | 124/49 |
| 6,349,711 B1 | | 2/2002 | Perry et al. | |
| 6,405,722 B2 | * | 6/2002 | Colby | 124/74 |
| 2002/0046747 A1 | * | 4/2002 | Colby | 124/73 |

FOREIGN PATENT DOCUMENTS

| | | |
|---|---|---|
| GB | 2056635 | 3/1981 |
| GB | 2 146 416 | 4/1985 |
| WO | WO97/26498 | 7/1997 |

* cited by examiner

*Primary Examiner*—Charles T. Jordan
*Assistant Examiner*—John W. Zeu
(74) *Attorney, Agent, or Firm*—Woodard, Emhardt, Moriarty, McNett & Henry LLP

(57) ABSTRACT

An improved pressure regulator for pneumatic guns, with an improved and simplified design incorporating a rotating gas fitting with a gas inlet port; modular construction to allow fitting to different pneumatic guns/air sources/configurations; better pressure output stability at pressures lower than 200 psi; and improved ease of maintenance. There is also a sliding, externally actuatable check valve for pneumatically isolating one pneumatic component of the paintball gun from another pneumatic component.

17 Claims, 7 Drawing Sheets

PRESSURE REGULATOR FOR PNEUMATIC GUNS

FIELD OF THE INVENTION

The present invention relates to pneumatic pressure regulators, and more specifically to pneumatic pressure regulators for pneumatic guns such as paintball guns.

BACKGROUND OF THE INVENTION

In the sport of paintball within the last five years, there has been increased use of pressure regulators on paintball guns. Some pressure regulators are used to control unwanted pressure spikes from CO2 bottles and nitrogen systems, thus keeping the pressure entering the pneumatic gun stable. More recently, with the use of better paintball gun valves, pressure regulators have been used to control the velocity of the ejected paintball by directly controlling the input pressure into the pneumatic gun's valve chamber. Some of the regulators used to control pressure spikes and pressures are inadequate to control velocity directly. One problem has been the lack of alignment adjustment for the air hose that supplies the regulator, which leads to improper arrangement of hoses, and which can become dangerous if the hoses are not properly installed. Some regulators also lack a stable output pressure at pressures lower then 200 psi. With other regulators there is the possibility of damaging the regulator if it is adjusted to regulate 200 psi or lower. This low pressure range has become increasingly important because many new paintball guns operate in a pressure range of 250 psi or less. Yet one other problem is their inability to be easily modified for another purpose. The present invention solves these problems in novel and unobvious ways.

SUMMARY OF THE INVENTION

One aspect of the present invention concerns an improved pressure regulator for a pneumatic gun capable of regulating pressures below 200 psi without damaging the regulator.

In another embodiment of the present invention, there is a rotatable gas fitting which couples to an external airline. Rotation of the gas fitting permits the external airline to be modified to a shape that is convenient to the user.

Yet another embodiment of the present invention relates to an externally actuatable sliding check valve. The user of the pneumatic gun can slide the check valve to a position in which there is flow communication between two pneumatic components, or slide the valve to another position in which flow from one of the pneumatic components is substantially sealed off.

Yet another embodiment of the present invention relates to a pressure regulator which is externally adjustable by the user of the pneumatic gun.

A further embodiment of the present invention relates to a pressure regulator for a pneumatic gun in which a slidable piston of the regulator is sealed by an o-ring. The o-ring is maintained in a counterbore by a planar member which is trapped between two threadably coupled static members.

Yet another embodiment of the present invention relates to a pressure regulator assembly which is modular, with regulator input bodies and regulator output bodies that adapt a central main pressure regulator to different pneumatic guns.

These and other embodiments of the present invention will be apparent from the drawings, description of preferred embodiment, and the claims to follow.

DESCRIPTION OF THE PREFERRED EMBODIMENT

Figure 1:
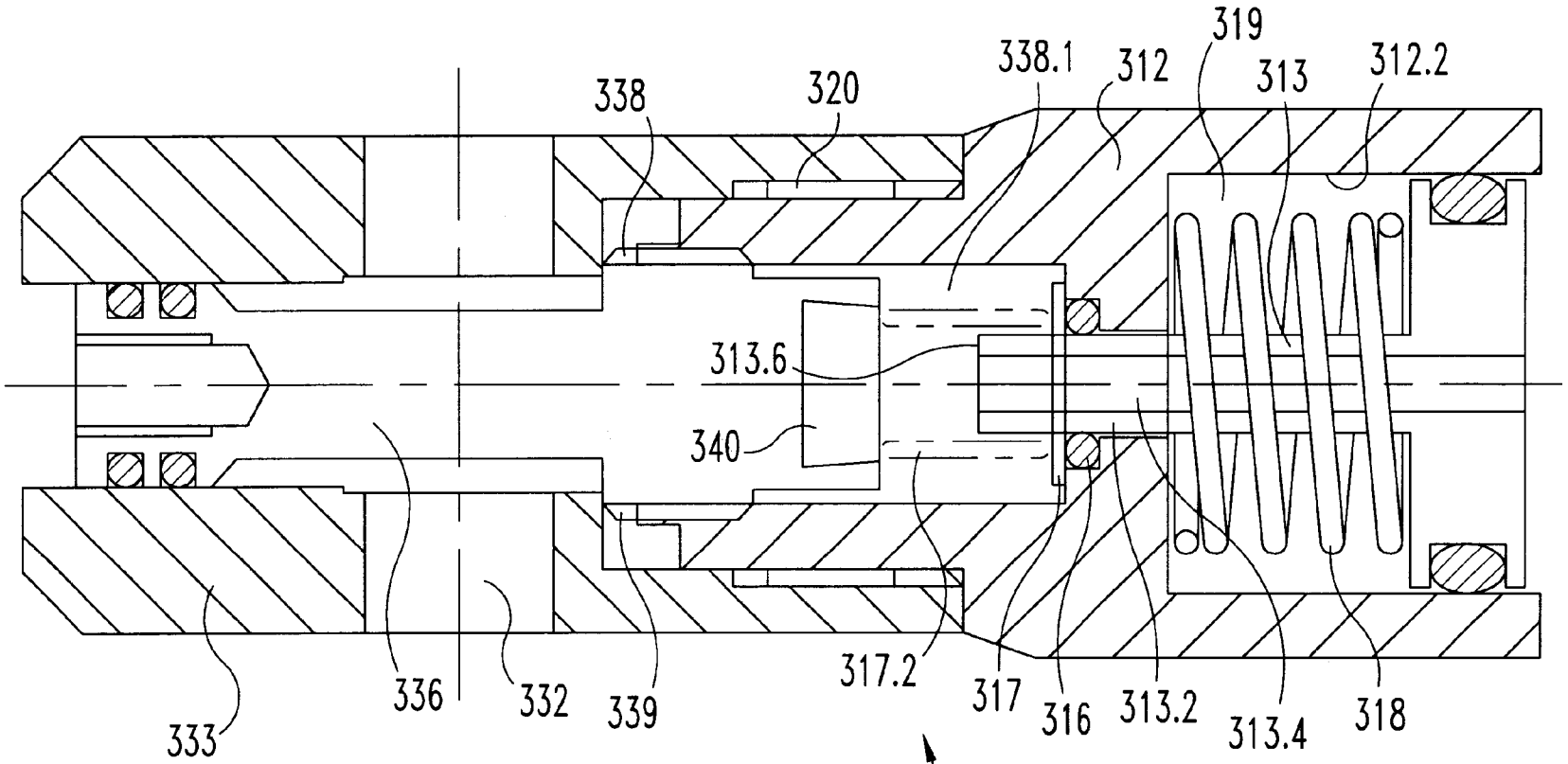
Fig. 1 (PRIOR ART)
FIG. 1 is a cross-sectional view of a portion of a prior art pressure regulator assembly.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

The present invention relates to apparatus and methods for various improvements to pneumatically powered guns. Various embodiments of the present invention include an improved pressure regulator assembly with an improved method of supplying air, the ability to adjust the regulator externally, modular construction, and the ability to provide regulated pressure output at pressures below the 200 psi bottom limit of other regulators. Another embodiment of the present invention includes an externally actuatable, on/off sliding check valve for isolating one pneumatic component from another pneumatic component. Other embodiments of the present invention include a gas fitting which provides the ability for the regulator to receive air from a 360 degree span. This application incorporates herein by reference U.S. patent application Ser. No. 09/630,109, filed Aug. 1, 2000, and entitled ELECTRONIC PNEUMATIC PAINTBALL GUN.

One embodiment of the present invention relates to a kit for a modular pressure regulator assembly for a pneumatic gun. In one embodiment there is a plurality of regulator input bodies, a main pressure regulator, and a plurality of regulator output bodies. Each of said plurality of regulator input bodies include a first threaded end for threadably coupling the regulator input body to the first threaded end of the main pressure regulator body. Preferably, each regulator output body includes a first threaded end for threadably coupling the regulator output body to a second threaded end of the main pressure regulator body. Each of the regulator input bodies, the main regulator body, and the regulator output bodies have a centerline, and the centerlines are coincident when a regulator input body and regulator output body are threaded into opposite ends of a main pressure regulator.

Other embodiments of the present invention include different configurations of regulator input body designs that allow the regulator assembly to be used in many different configurations and set-ups. In one embodiment, the regulator input body includes a swiveling gas fitting. This gas fitting rotatably couples to the regulator input end cap and allows the input air to enter the regulator within a 360 degree field of rotation. This gas fitting helps to insure the alignment of the input air fitting from the high pressure source of the pneumatic gun. In some embodiments this swivel end cap also permits external adjustability of the pressure setting of the regulator assembly. Another embodiment of the input end cap allows the regulator assembly to be attached to the bottom of the paintball gun's grip, and for a $CO_2$ or compressed air bottle to be screwed into the regulator assembly.

Other embodiments of the present invention include a sliding, on/off check valve. This sliding check valve allows the user to shut off the flow of gas from the regulator and preferably also bleed the air out of the firing chamber or other pneumatic component of the paintball gun to the atmosphere. In other embodiments of the present invention, the sliding check valve can be used to isolate one pneumatic component from another pneumatic component, without any bleeding of stored compressed gas.

The present invention includes embodiments having a pressure regulator with various improvements over a prior art pressure regulator. A prior art pressure regulator (325) is shown in FIG. 1. Regulator (325) includes an input regulator static member (333) threadably coupled to a main regulator static body (312) by threads (320). A regulator core (336) is threadably received within main regulator body (312) by threads (339). The other end of core (336) is slidably retained within a bore of static member (333). Core (336) included a resilient sealing seat (340) which comes into sealing contact with one end (313.6) of a sliding piston (313). Thus one end of core (336) is threadably received within main regulator body (312), and the other end of core (336) is slidingly received within static member (333). Regulator (325) also includes a piston (313) slidably received within a bore (312.2). A spring (318) biases piston (313) away from core (336).

In operation, compressed air from a source enters regulator assembly (325) through an input port (332), and flows through grooves (338) located along threads (339) into a chamber (338.1) which is in fluid communication with internal passage (313.4) of piston (313). The compressed air travels to a chamber (not shown) to the right side of piston (313), where the pressure acts to slide piston (313) toward the left. Piston (313) continues to slide to the left, opposed by the force of spring (318), until the end (313.6) of the piston (313) comes into sealing contact with sealing seat (340). Contact between end (313.6) and seat (340) shuts off the flow of air, with the air to the right of piston (313) being at the regulated pressure.

Piston (313) is slidable within a bore (312.2) of static member (312) toward seat (340). Therefore, the adjustment of core (336) inward toward piston (313) reduces the travel required for end (313.6) to contact seal (340), lowers the spring force the piston must overcome, and also lowers the regulated pressure. However, regulator (325) is limited in the extent to which core (336) can be moved toward the right, as shown in FIG. 1. This is because of the manner in which an o-ring (316) is captured between washer (317) and a counterbore of static member (312). o-ring (316) is held in by a washer (317) and spring (317.2) which bias o-ring (316) into sealing contact with shaft (313.2) of piston (313). Spring (317.2) limits the minimum distance achievable between seat (340) and piston (313). This limitation occurs because spring (317.2) and seat (340) are over compressed and crushed or damaged if core (336) is moved too close to piston (313). Therefore, this prior art pressure regulator cannot be lowered to regulating pressures less than about 250 psi without damaging the spring or sealing seat of the pressure regulator by overcompression.

Figure 2:
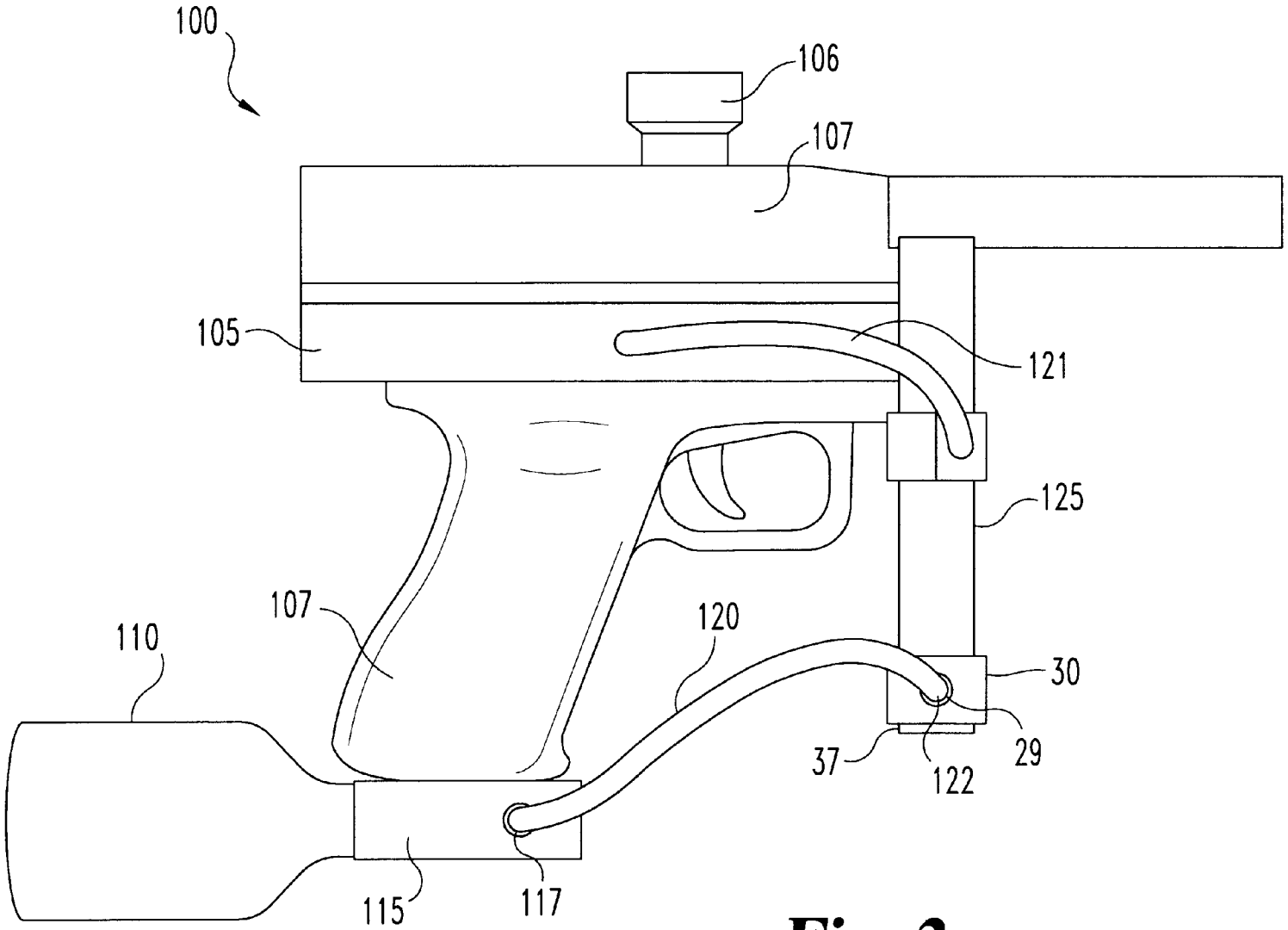
FIG. 2 is a side elevational view of an apparatus according to one embodiment of the present invention.

A pressure regulator according to one embodiment of the present invention overcomes this problem in a manner which will be described. Referring to FIG. 2, apparatus (100) according to one embodiment of the present invention includes a pneumatic gun (105), such as a pneumatic gun for delivery of paintballs. Pneumatic gun (105) includes a loading aperture (106) for loading paintballs into an internal firing chamber (107) (not shown). Apparatus (100) includes a reservoir or source (110) of compressed gas, such as CO2 or air. In one embodiment, source (110) is threadably coupled onto a static member (115) which is attached to grip (107) of gun (105). Static member (15) includes an output port (117) to which one end of an external gas line (120) is coupled. The other end (122) of external gas line (120) is coupled to a gas port (29) of pressure regulator assembly (125). Gas port (29) includes internal threads which are threadably coupled to the external threads on the end (122) of external gas line (120). Regulator assembly (125) regulates the gas provided at a first, higher pressure from source (110) to a second, lower regulated pressure which is provided from regulator assembly (125) to other pneumatic components of gun (105). In some embodiments, the regulated pressure is provided by an external airline (121) from the regulator output port to another pneumatic component of gun (105).

Figure 3:
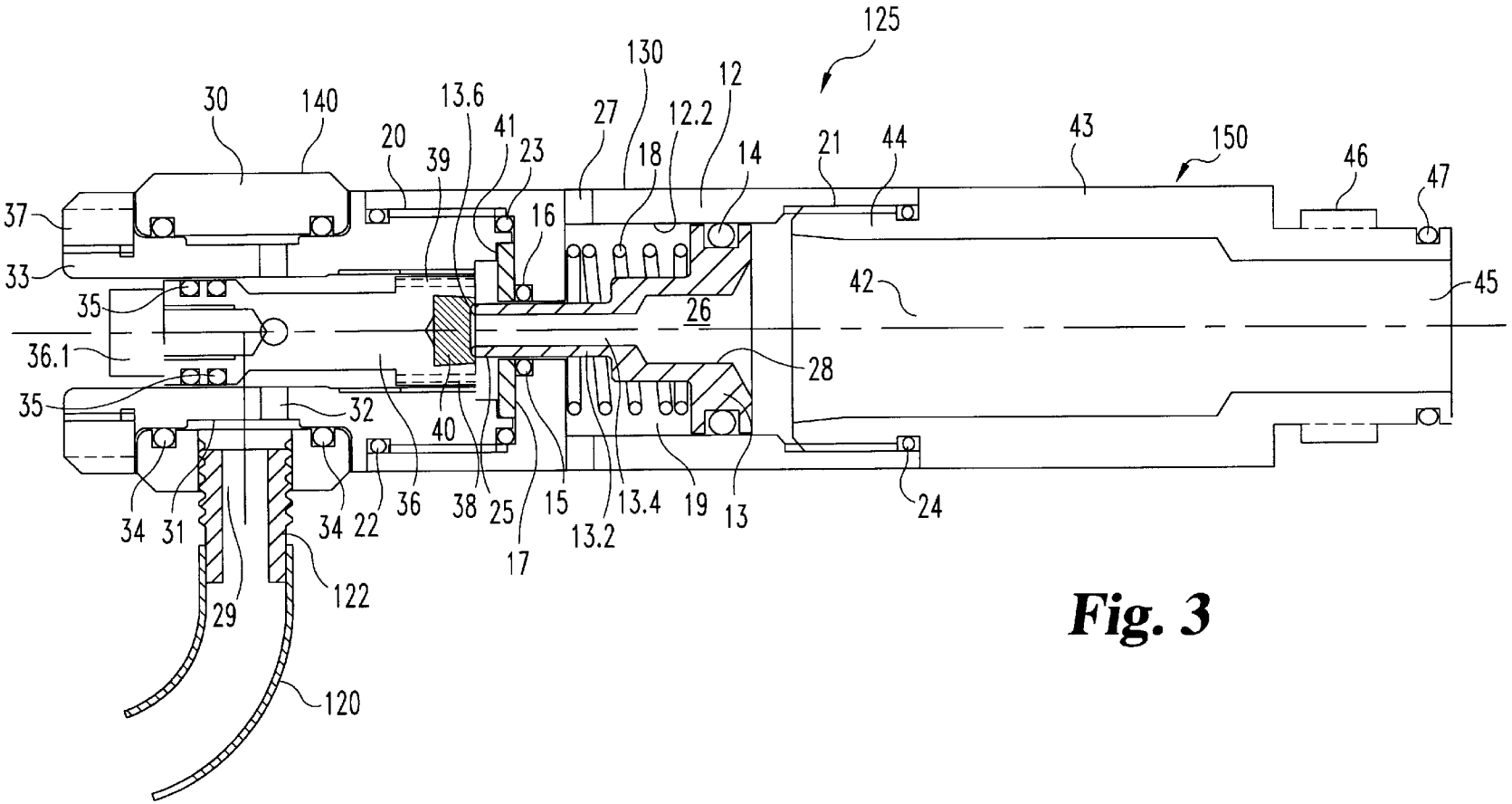
FIG. 3 is a cross-sectional view of the pressure regulator of FIG. 2.

Referring now to FIG. 3, there is shown a pressure regulator assembly (125) according to one embodiment of the present invention. Assembly (125) includes a regulator input body (140), a main pressure regulator (130), and a regulator output body (150), all threadably coupled together along a single centerline. The regulator input body static member (33) is sealed to main regulator body static member (12) by o-rings (22) and (23).

Regulator input body (140) preferably includes a regulator core (36) threadably received by threads (39). This core includes a resilient sealing seat (40) that seals against one end (13.6) of the slidable regulator piston (13) as the compressed gas moves piston (13) toward the left. The position of core (36) in regulator input static member (33) is externally adjustable by a hand tool such as an Allen wrench received within a complementary-shaped head (36.2) of core (36). a pair of o-rings (35) seal the central portion of core (36) from ambient conditions. Turning of core (36) increases or decreases the maximum distance of regulator sealing seat (40) from regulator piston (13), which in turn adjusts the output pressure of the regulator. Core (36) is threadably received within the regulator input body static member (33), in contrast to regulator (325), where core (336) is threadably received within threads (339) of main regulator body (312).

Static member (33) retains regulator washer (17) trapped in a counterbore (41) when static members (33) and (12) are threadably coupled together. In turn, washer (17) holds o-ring (15) in place inside the counterbore (16) in main regulator static member (12), forming a seal around the shaft (13.2) of regulator piston (13). Thus, pressure regulator assembly (125), in contrast to prior art regulator assembly (325), does not use a spring to retain a seal around the shaft of the piston.

Figure 4:
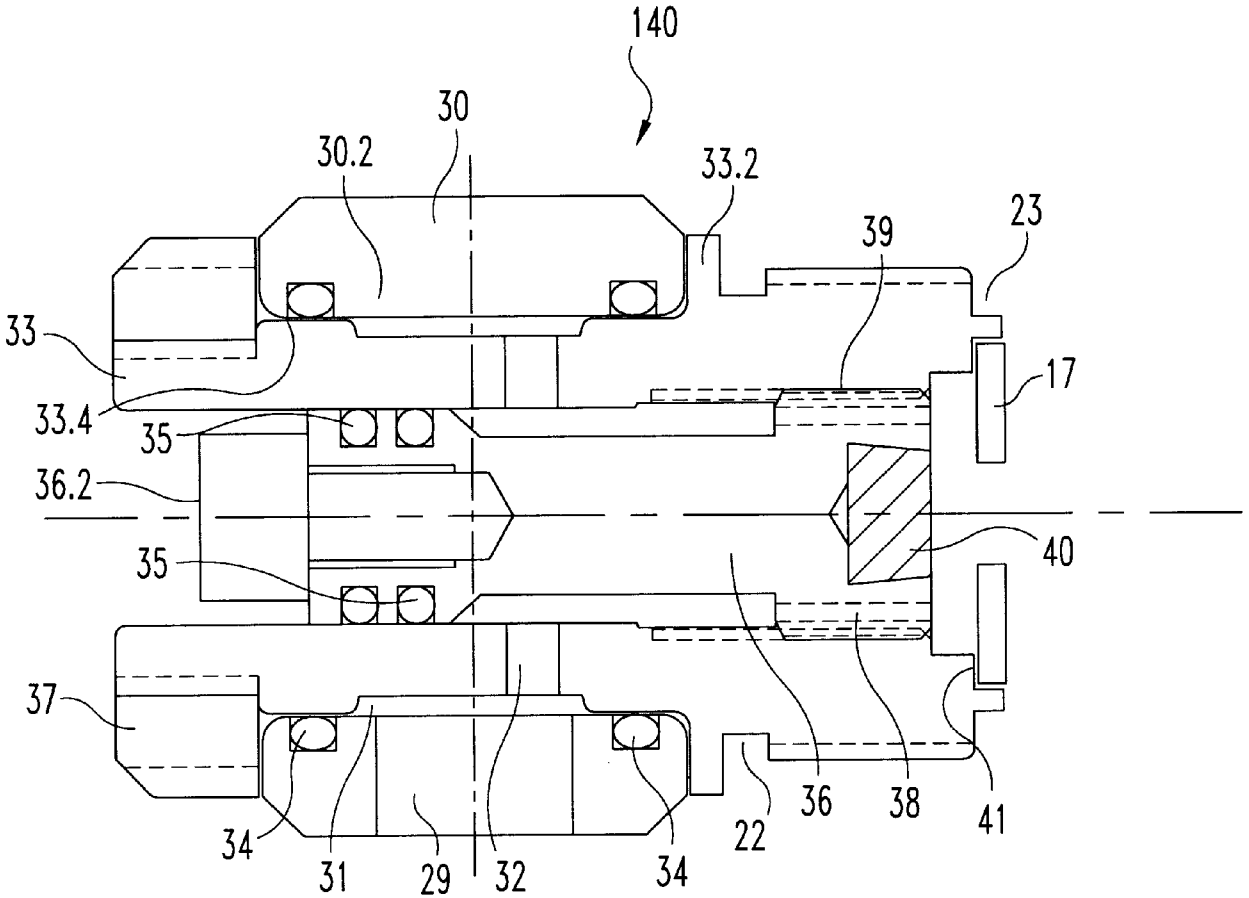
FIG. 4 is a cross-sectional view of the input section of FIG. 3.

Referring now to FIGS. 3 and 4, regulator input body (140) includes a swiveling gas fitting (30). Gas fitting (30)

includes a generally cylindrical inner wall (30.2), and defines hole (29) through inner wall (30.2). Hole (29) includes appropriate fastening features to accept one end of airline (120) (See FIG. 2). Input body static member (33) includes a generally cylindrical outer wall (33.4), around which gas fitting (30) is rotatable. Gas fitting (30) is loosely trapped between the end of fastener (37) and a shoulder (33.2) of static member (33). Gas fitting (30) is able to rotate freely around a 360 degree arc.

Gas enters through side hole (29) of gas fitting (30) and travels around a channel or groove (31) of regulator input static member (33), and then through holes (32) drilled through static member (33). After the gas passes through holes (32), the gas then travels along the outside of regulator core (36), passes through grooves (38) milled into threads (39) of the regulator core, and then flows around regulator sealing seat (40). The gas is sealed in by dual o-ring seals (34) on gas fitting (30) and dual o-ring seals (35) on the moveable regulator core (36).

Referring to FIG. 3, main pressure regulator (130) includes a static member (12) having a bore (12.2) which slidably receives the regulator piston (13) and piston o-ring (14). Piston (13) includes a larger diameter counterbored end (28), a shaft portion (13.2) which extends through a sealed aperture of static body (12), and a smaller diameter apertured end (13.6) of shaft (13.2). The static member (12) also includes an o-ring (15) in counterbore (16) which forms a seal around the piston shaft (13.2). Flow passage (13.4) through piston shaft (13.2) provides fluid communication from high pressure side (25) of main regulator body (130) to low pressure side (26). A regulator piston spring (18) in a spring chamber (19) urges piston (13) away from high pressure side (25) and toward low pressure side (26).

Internally threaded ends (20) and (21) of static member (12) allow for threaded coupling of member (12) to the static members of a regulator input body and regulator output body, respectively. o-ring seals (22) and (23), and (24) seal the high pressure (25) and low pressure (26) gas, respectively, inside the regulator body (130). A vent hole (27) in spring chamber (19) allows atmospheric air pressure into this part of the regulator so that pressurized gas cannot build up in chamber (19). The internal counterbore of piston (13) at end (28) increases surface area for the gas to push against piston (13) without increasing the size of the piston, and also lowers the mass of the piston.

Pressure regulator assembly (125) also includes a regulator output body (150). Output body (150) includes a static member (43) which defines an internal gas chamber (42). One end of static body (43) includes threads (44) which are threadably received within mating threads (21) of main pressure regulator (130). The other end of static member (43) includes threads (46) for threadably receiving another pneumatic component of gun (105). Static member (43) includes a centerline which is coaxial with the centerline of main pressure regulator (130) when threads (21) and (44) are coupled together.

Figure 5:
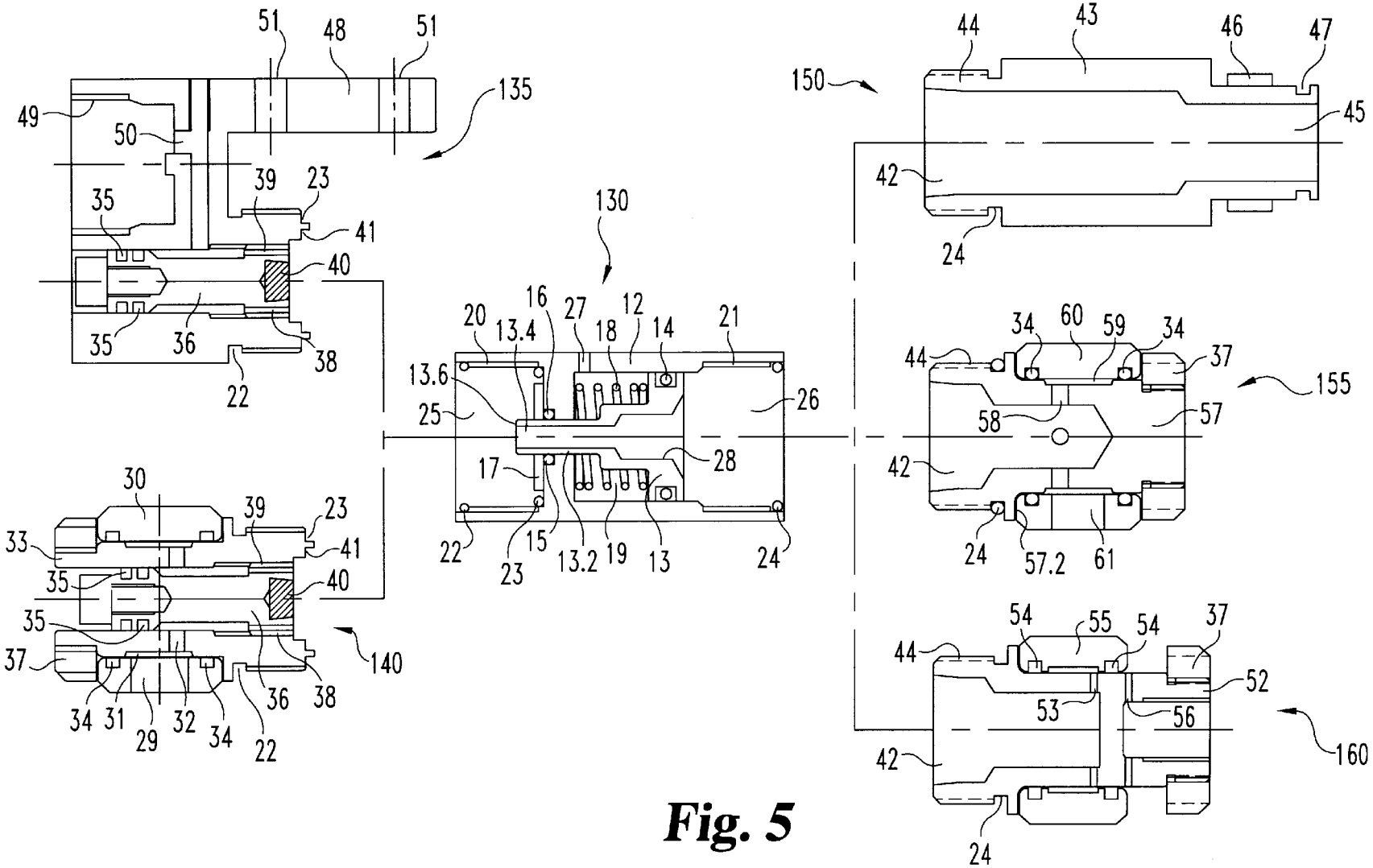
FIG. 5 are exploded, cross-sectional views of the modular sections for a pressure regulator assembly according to another embodiment of the present invention.

Referring now to FIG. 5, a pressure regulator assembly according to another embodiment of the present invention preferably includes a main regulator body (130) which can be threadably coupled to a plurality of input bodies and output bodies in a modular manner. A pressure regulator assembly can thus be constructed by selecting a particular input body, coupling it to the input end of main regulator body (130), and selecting a regulator output body and coupling it to the output end of main regulator body (130). Main pressure regulator (130) can accept either regulator input body (140) or (135). Main regulator body (130) can also accept any one of the regulator output bodies (150), (155), or (160). As depicted in FIG. 5, the modularity, co-action, and coupling of the regulator input body, main regulator body, and regulator output body allows numerous combinations of pressure regulator assemblies. When coupled together, the input body, regulator body, and output body are linearly arranged, sharing a common centerline. The use of like numerals refers to features identical to those previously described.

One embodiment of the regulator input body (140) includes a swiveling gas fitting (30), as previously described. In another embodiment, the regulator input body (135) includes threads (49) for accepting the threaded neck of a tank of a pressure source (110), and preferably also holes (51) for attaching the input end cap to the hand gun grip (107). Preferably, both regulator input bodies (135, 140) include a threadably received core (36) which can be rotated by a user while installed on the pneumatic gun to change the distance between a resilient sealing seat (40) and a piston (13), and thus adjust the regulated output pressure.

A modular pressure regulator assembly according to one embodiment of the present invention includes a plurality of regulator output bodies (150, 155, 160). Regulator output body (150), as previously described, includes a threaded static member (43) for threadably coupling the pressure regulator assembly to the pneumatic gun or a component thereof.

Figure 7:
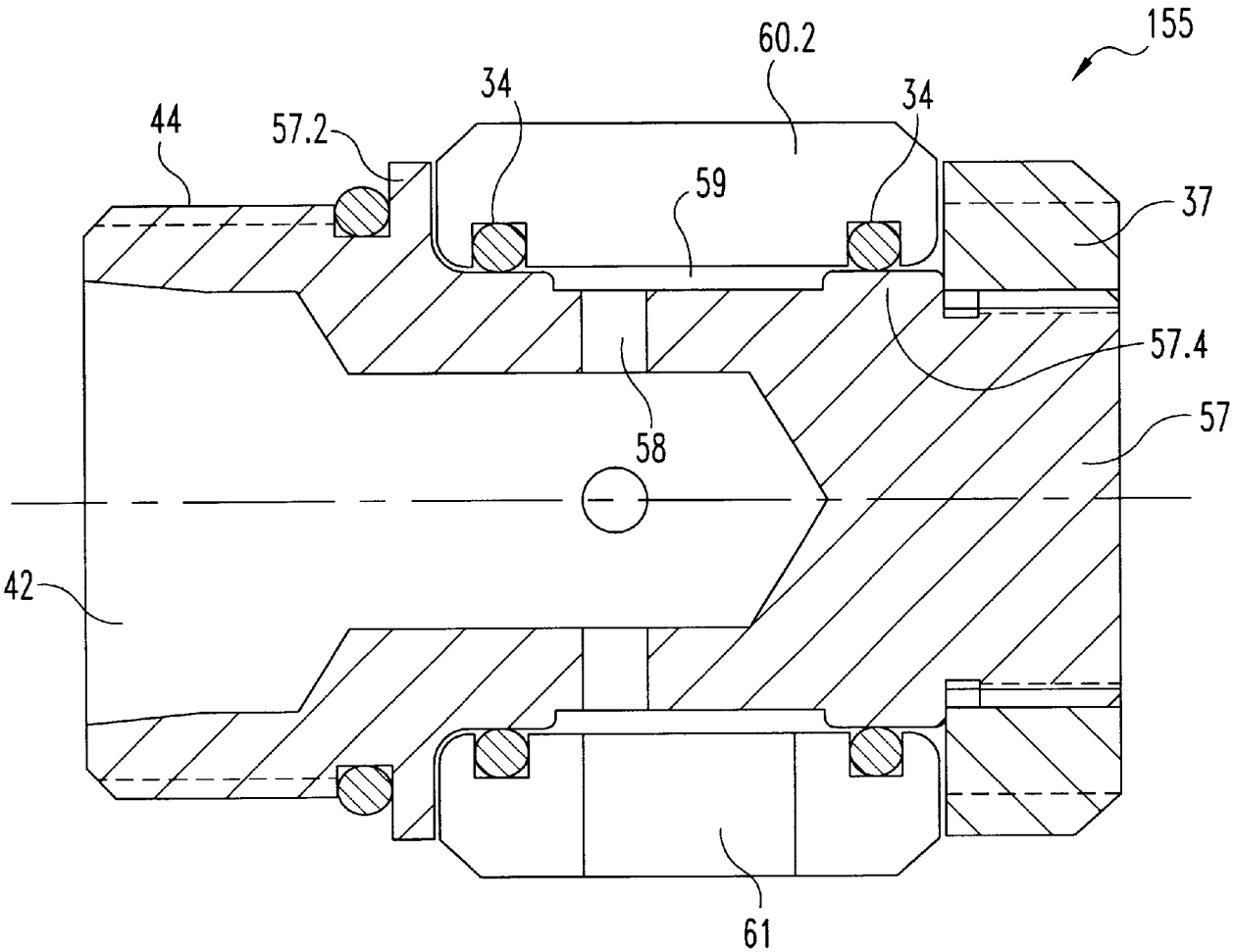
FIG. 7 is a cross-sectional view of one of the modular output sections of FIG. 6.

Regulator output body (155) (referring to FIGS. 5 and 7) includes a swiveling gas fitting (60) for coupling to an external air hose, which provides the ability to swivel the end of the coupled external air line (121) to a convenient position that does not interfere with operation of the pneumatic gun.

The construction of regulator output body (155) is similar to that of regulator input body (140) with regards to the swiveling gas fitting. Gas fitting (60) includes a generally cylindrical inner wall (59), and defines a hole (61) through inner wall (59). Gas fitting (60) includes suitable features around hole (61) for coupling to an external airline (121) (as seen in FIG. 2). Output body static member (57) includes a generally cylindrical outer wall (57.4) around which gas fitting (60) is rotatable. Gas fitting (60) is loosely trapped between the end of a fastener (37) and a shoulder (57.2) of static member (57). Gas fitting (60) is able to rotate freely around a 360 degree arc. Gas at a regulated pressure within chamber (42) is free to pass through one of a plurality of holes (58) which are in fluid communication with output hole (61).

Figure 6:
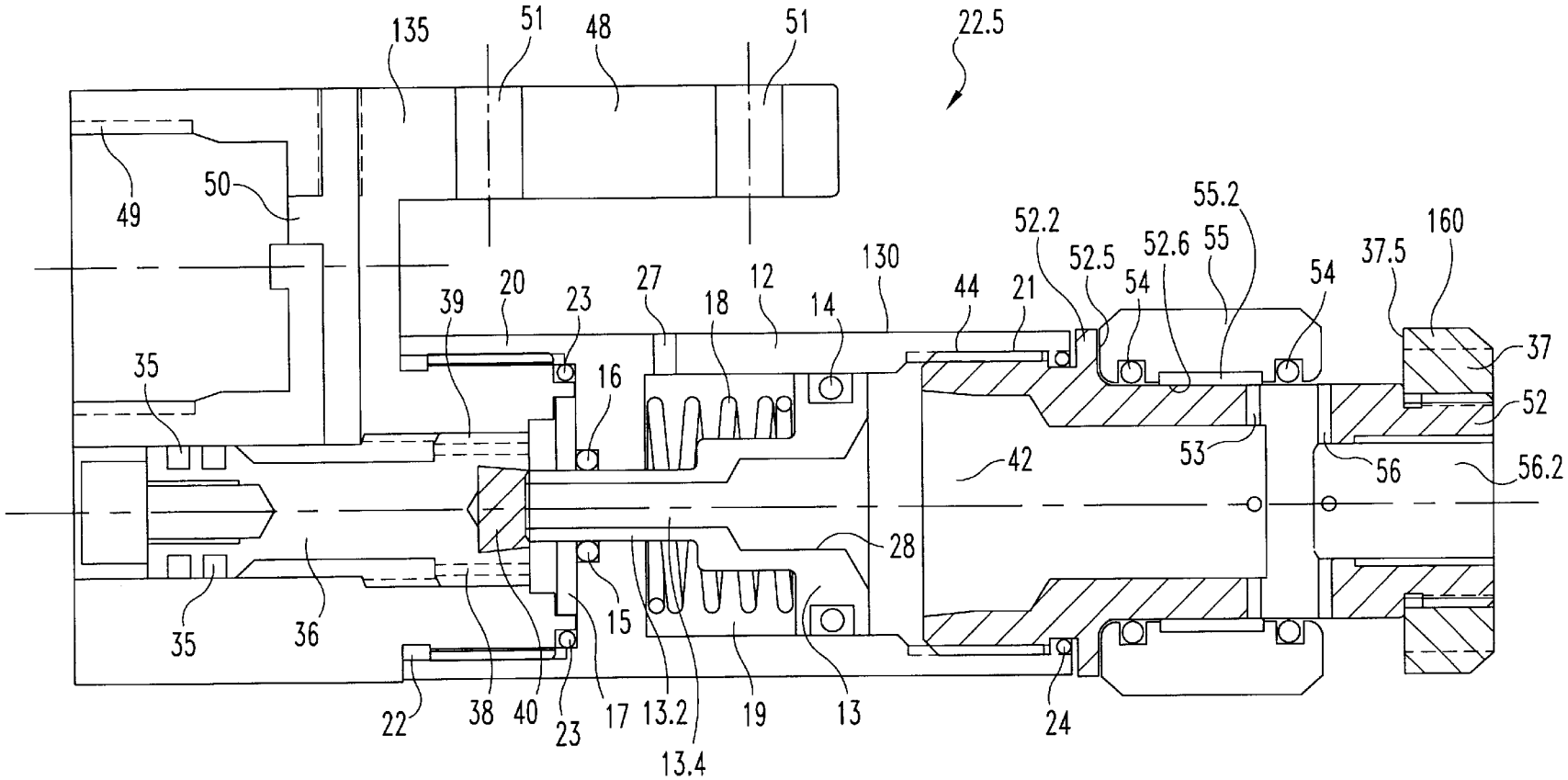
FIG. 6 is a cross-sectional view of a pressure regulator assembly according to another embodiment of the present invention.

Referring to FIGS. 5 and 6, regulator output body (160) includes an externally actuatable, sliding check valve (55), which is slidable to one position which permits flow of gas at a regulated pressure to another pneumatic component of the gun, and is slidable to another position in which flow out of the main pressure regulator (130) is substantially sealed off. In yet another embodiment of the present invention, in the second position the second component is also vented to ambient pressure.

FIG. 6 depicts a pressure regulator assembly (225) according to another embodiment of the present invention. Pressure regulator assembly (225) includes a pressure input body (135), a main regulator body (130), and a regulator output body (160) incorporating a sliding check valve (55). Regulator assembly (225) includes a lower body static member (48) that mounts to a grip frame (107) of a gun (100). A source of gas (110) is threadably coupled into regulator input body static member (48) by means of threads (49). Gas from that source (110) enters air passage (50) and travels to the side of the regulator core (36). The main regulator body static member (12) and the regulator output body static member (52) are threaded together by threads (21) and (44) and sealed by o-ring (24). Holes (51) on regulator input body static member (48) are used for fasteners to attach the static member to the bottom of grip frame (107) on a pneumatic gun (105).

Operation of sliding check valve (55) will now be described. Regulated gas flowing through piston (13) and into the bore of chamber (42) travels through gas passage (53), into flow channel (55.2), and is stopped by o-ring seals (54) within check valve (55). Check valve (55) is slidable over outer surface (52.6) of static member (52), between a travel stop (37.5) of fastener (37) and a travel stop (52.5) of static member (52). When valve (55) is slid toward travel stop (37.5) of fastener (37), the gas in channel (55.2) travels through air passage (56) then through bore (56.2) and out to a pneumatic component of gun (105). When check valve (55) is slid toward main pressure regulator (130), gas stops flowing through air passage (53) of static member (52), and is trapped between the pair of o-rings (54). Preferably, any gas stored in any pneumatic component downstream of assembly (225) past collar (55) is allowed to vent to ambient through flow passage (56). Subsequent sliding of valve (55) to travel stop (37.5) re-establishes fluid communication from passage (53) through channel (55.2) to flow passage (56), and out bore (56.2) to a valve or other pneumatic component of gun (105).

Operation of a pressure regulator assembly according to one embodiment of the present invention will now be described. Referring again to FIG. 3, regulator piston (13) is held open (to the right) by spring force from regulator springs (18). Prior to the flow of gas, sealing seat (40) and the end (13.6) of piston (13) are spaced apart by a maximum pre-selected distance. This maximum pre-selected distance can be adjusted by rotating core (36) and sealing seat (40) about threads (39). This rotation will change the axial position of core (36) and sealing seat (40) within pressure regulator assembly (125). As oriented in FIG. 3, axial movement of core (36) toward piston (13) (toward the right), reduces the regulated output pressure, since a lower pneumatic force acting on piston (13) places the end of shaft (13.2) in sealing contact with sealing seat (40). Likewise, axial movement of core (36) toward the left increases the distance that piston (13) must travel before contacting sealing seat (40), and therefore increases the regulated output pressure.

High pressure gas provided from source (110) flows through input body (140), travels through the passage (13.4) in regulator piston (13), and exits to the side of piston (13) with counterbores (28). As compressed gas fills chamber (26) and chamber (42), force is applied to piston (13) to move the piston toward sealing seat (40) of adjustable core (36) (to the left).

As the gas pressure builds in chambers (26, 42), the piston (13) compresses spring (18). As pressure builds up in chamber (42), the pressure difference between chambers (42) and (19) causes piston (13) to move toward sealing seat (40). Once piston (13) has traveled the maximum pre-selected distance, the end (13.6) of piston shaft (13.2) comes into sealing contact with sealing seat (40), the flow of pressurized gas through passage (13.4) ceases, and the gas pressure in chambers (26, 42) is at the pre-selected pressure. As piston (13) is pushed to the left, gas in the spring chamber (19) is forced out of vent hole (27). Vent hole (27) prevents the build-up of gas pressure within chamber (19).

Gas is allowed to exit the open end (45) of static member (43), and flow onto another pneumatic component, such as a firing chamber, of gun (105). As the downstream component uses the volume of compressed gas in chambers (42, 26), the gas pressure drops, and the force of springs (18) push piston (13) away from sealing seat (40), allowing the flow of air once again around core (36), past seat (40), into flow passage (13.4), and into chambers (42, 26). When output pressure in chamber (42) flows to a downstream pneumatic component, springs (18) bias piston (13) away from sealing seat (40) by the maximum pre-selected distance. This maximum distance diminishes as compressed gas flows in through inlet (29), around core (36), through passage (13.4), and into chamber (42). As the end (13.6) of piston (13) moves out of sealing contact with seat (40), gas is again permitted to flow from source (110).

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An apparatus comprising:

a reservoir for gas;

a pneumatically powered gun having a static member and a rotatable gas fitting, said static member including an outer wall generally cylindrical about an axis, said gas fitting having an inner wall generally cylindrical about said axis and defining a hole through said inner wall for passage of gas, the inner wall of said gas fitting being rotatably slidable about the outer wall of said static member; and an external gas line with an end coupled to said rotatable gas fitting, said gas line providing fluid communication between said reservoir and said gas fitting;

wherein said reservoir is a source of compressed gas, the hole is a gas inlet, and said gas line provides gas from the source to said gas fitting.

2. The apparatus of claim 1 wherein said gun is a pneumatically powered paintball gun including a firing chamber, and said rotatable gas fitting provides gas to said firing chamber.

3. The apparatus of claim 1 wherein the inner wall is cylindrical about a first axis, said hole is generally cylindrical about a second axis, and the first axis is not parallel to the second axis.

4. The apparatus of claim 1 wherein said hole includes internal threads and said gas line includes an end with external threads threadably couple to the internal threads.

5. The apparatus of claim 1 wherein said gun is a pneumatically powered paintball gun including a pressure regulator having a moving piston, and said rotatable gas fitting provides gas to said pressure regulator.

6. An apparatus comprising:

a reservoir for gas;

a pneumatically powered gun having a static member and a rotatable gas fitting, said static member including an outer wall generally cylindrical about an axis, said gas fitting having an inner wall generally cylindrical about said axis and defining a hold through said inner wall for passage of gas, the inner wall of said gas fitting being rotatably slidable about the outer wall of said static member; and an external gas line with an end coupled to said rotatable gas fitting, said gas line providing fluid communication between said reservoir and said gas fitting;

wherein said static member includes a shoulder and a threaded end with the cylindrical outer wall being between the shoulder and the threaded end, and which further comprises a fastener, said gas fitting being slidable over the cylindrical outer wall to an abutting relationship with the shoulder, said fastener being threadably coupled to the threaded end of said static member for capturing said gas fitting on said static member between said fastener and the shoulder.

7. The apparatus of claim 6 wherein said reservoir is a source of compressed gas, the hole is a gas inlet, and said gas line provides gas from the source to said gas fitting.

8. The apparatus of claim 6 wherein said reservoir is a receiver of compressed gas, the hole is a gas outlet, and said gas line provides gas from said gas fitting to said receiver.

9. The apparatus of claim 6 wherein said gun is a pneumatically powered paintball gun including a firing chamber, and said rotatable gas fitting provides gas to said firing chamber.

10. The apparatus of claim 6 wherein the inner wall is cylindrical about a first axis, said hole is generally cylindrical about a second axis, and the first axis is not parallel to the second axis.

11. The apparatus of claim 6 wherein said hole includes internal threads and said gas line includes an end with external threads threadably coupled to the internal threads.

12. The apparatus of claim 6 wherein said gun is a pneumatically powered paintball gun including a pressure regulator having a moving piston, and said rotatable gas fitting provides gas to said pressure regulator.

13. An apparatus comprising a supply of compressed gas;

a pneumatically powered gun having a pneumatic component and a first member having an outer surface, a bore provided with the compressed gas, an outer surface surrounding the bore, a first passage providing fluid communication from the bore to the outer surface, and a second passage providing fluid communication from the outer surface to said pneumatic component; and a collar having an inner surface and an exterior surface, the inner surface of said collar being manually slidable over the outer surface of said first member by a user gripping the exterior surface, said collar being slidable between first and second positions, said collar defining a channel for flow of compressed gas;

wherein sliding said collar to the first position establishes fluid communication from the first passage through the channel to the second passage and to said pneumatic component, and sliding, of said collar to the second position substantially seals off flow out of the first passage.

14. The apparatus of claim 13 wherein sliding of said collar to the second position vents second passage to ambient.

15. The apparatus of claim 13 wherein said pneumatic component is a firing chamber.

16. The apparatus of claim 13 wherein said collar includes a seal for substantially restricting leakage of compressed gas between the inner surface and the outer surface.

17. The apparatus of claim 13 which further comprises a releasable fastener for retaining said collar onto said first member, said fastener including a surface which abuts said collar when said collar is in the first position.

* * * * *

UNITED STATES PATENT AND TRADEMARK OFFICE

CERTIFICATE OF CORRECTION

PATENT NO. : 6,675,791 B1
DATED : January 13, 2004
INVENTOR(S) : Aaron K. Alexander et al.

It is certified that error appears in the above-identified patent and that said Letters Patent is hereby corrected as shown below:

Column 8,
Line 53, please remove the word “couple” and insert in lieu thereof -- coupled --.
Line 66, please remove the word “hold” and insert in lieu thereof -- hole --.

Signed and Sealed this

Fourth Day of January, 2005

JON W. DUDAS
*Director of the United States Patent and Trademark Office*